United States Patent [19]

Schittenhelm et al.

[11] Patent Number: 4,713,530

[45] Date of Patent: Dec. 15, 1987

[54] HEATING ELEMENT COMBINED GLASS/ENAMEL OVERCOAT

[75] Inventors: Hans-Joachim Schittenhelm, Leverkusen; Werner Joseph, Cologne; Gerhard Trögel, Leverkusen, all of Fed. Rep. of Germany

[73] Assignee: Bayer Aktiengesellschaft, Leverkusen, Fed. Rep. of Germany

[21] Appl. No.: 912,446

[22] Filed: Sep. 26, 1986

[30] Foreign Application Priority Data

Oct. 11, 1985 [DE] Fed. Rep. of Germany ..... 3536268

[51] Int. Cl.[4] ..... H05B 3/16; H01C 1/012; B05D 1/36

[52] U.S. Cl. ..... 219/543; 219/457; 219/548; 338/293; 338/308; 427/103; 427/402

[58] Field of Search ..... 219/457, 458, 460, 542, 219/543–548, 552; 338/307–311, 293; 427/58, 88, 318, 402, 405, 103

[56] References Cited

U.S. PATENT DOCUMENTS

| | | | |
|---|---|---|---|
| 2,837,619 | 6/1958 | Stein | 338/2 |
| 2,842,648 | 7/1958 | Reynolds | 338/26 |
| 3,974,360 | 8/1976 | Panzarino | 219/543 |
| 4,033,776 | 7/1977 | Golya et al. | 106/46 |
| 4,209,764 | 6/1980 | Merz et al. | 338/308 |
| 4,234,786 | 11/1980 | Borom et al. | 219/544 |
| 4,406,994 | 9/1983 | Brech | 338/296 |

FOREIGN PATENT DOCUMENTS

| | | |
|---|---|---|
| 0112922 | 7/1984 | European Pat. Off. . |
| 2329424 | 1/1975 | Fed. Rep. of Germany . |
| 1402630 | 5/1965 | France . |
| 1488875 | 6/1967 | France . |

*Primary Examiner*—E. A. Goldberg
*Assistant Examiner*—Gerald E. Preston
*Attorney, Agent, or Firm*—Sprung Horn Kramer & Woods

[57] ABSTRACT

A panel heating element comprising (a) a metal substrate, (b) an aluminum boron-silicate insulating glass which forms a coating on the metal substrate, (c) one or more metallic resistance tracks applied to the substrate and (d) a mixture of a zirconium phosphate glass and a boron-titanium enamel which is applied as a layer over the metallic resistance tracks.

7 Claims, No Drawings

HEATING ELEMENT COMBINED GLASS/ENAMEL OVERCOAT

The present invention relates to heating elements consisting of a composite system of metal substrate, a base layer of electrically insulating glass applied to the substrate, metal conductors and a chemically resistant covering layer of glass.

Panel heating elements based on enamelled steel sheet are known per se. Electric resistances in the form of heating lacquers or pastes containing metal or metallic conductive strips are applied to the enamelling. Conventional enamelling to serve as electric insulator has the disadvantage that the volume resistance decreases with increasing temperature. In addition, the operational safety of enamelled panels is liable to be adversely affected by blisters, pores or weak points resulting from the manufacturing process.

The conductive heating tracks are protected against contact, for example by the application of foam plastics or by means of metal grids but such panel heating elements nevertheless fail to conform to safety regulations in some countries. Moreover, the heating power is limited since the surface temperature must be limited to about 100° C. for constructional reasons. These disadvantages may be overcome by using novel heating elements which are resistant to temperature changes.

The present invention relates to a panel heating element consisting of a metal substrate coated with an insulating glass and metallic resistance tracks applied to the substrate, characterised in that the insulating glass is a calcium-aluminium-boron-silicate glass and that an additional layer consisting of a mixture of zirconium phosphate glass and a boron-titanium enamel is placed above the metallic resistance tracks.

According to the invention, the layer of insulating glass consists of an alkali-free calcium-aluminium-boron-silicate glass (29 to 34% by weight CaO, 7 to 10% by weight $Al_2O_3$, 43 to 48% by weight $B_2O_3$, 8 to 15% by weight $SiO_2$, 1 to 2% by weight MgO).

After it has been fired on steel substrates, it can be subjected to temperatures up to 400° C. without suffering any significant loss in electric volume resistance. In contrast to conventional enamelling, which has an irregular bubble structure, which is almost impossible to control, the insulating glass is distinguished in its fired condition by a uniform, fine, statistically distributed bubble structure.

The insulating glass according to the invention may be applied to a cold rolled sheet coated with conventional base enamel or it may be applied directly to decarbonized steel sheet.

Steel substrates of decarbonized steel are found to be particularly suitable. This decarbonized steel is degreased in the manner normally employed for direct white enamelling and intensively pickled with acid and nickel plated (see, e.g., A. H. Dietzel, *Emaillierung*, Springer Verlag 1981, pages 214 et seq).

A clay-free slip of insulating glass is applied by immersion or spraying to the steel panels which have been treated as described above, and while the layer of slip is still wet the metallic heating conductor is placed on it, care being taken not to include air, and the components are dried together and fired in the usual manner at 820° to 840° C.

To protect the heating conductors against corrosion and for safety reasons as well as for aesthetic effect, it has been attempted to apply commercial enamel frits as covering layer.

These have the disadvantage of insufficient resistance to temperature changes. The covering layer of enamel tends to crack and peel off even when the heating elements produced as described above are heated only to about 300° C. and subsequently cooled in air.

It has now surprisingly been found that the resistance to temperature changes of the composition of an insulating glass, a heating conductor and a covering layer may be substantially improved by using a combination of a glass which is rich in zirconium phosphate and contains $Ba_2Zr_2Si_3O_{12}$ crystals with a titanium white enamel with $TiO_2$ recrystallization.

When such heating elements covered with covering glasses are used, the composite system may be heated to 400° C. and subsequently sprayed with cold water without showing any signs of damage in the form of cracks or peeling.

Suitable zirconium phosphate glasses may have approximately the following composition:

| | |
|---|---|
| $ZrO_2$ | 26–30% by weight |
| $P_2O_5$ | 21–25% by weight |
| $SiO_2$ | 7–25% by weight |
| $Na_2O$ | 6–10% by weight |
| $K_2O$ | 8–12% by weight |
| $TiO_2$ | 6–10% by weight |
| BaO | 8–12% by weight |
| F | 3–8% by weight |

A zirconium phosphate glass component having the following oxidic composition was found to be particularly suitable:

| | % by wt. | | % by wt. |
|---|---|---|---|
| $SiO_2$ | 9.5 | $Na_2O$ | 8.4 |
| $TiO_2$ | 7.3 | $K_2O$ | 9.4 |
| $ZrO_2$ | 27.5 | BaO | 10.7 |
| $P_2O_5$ | 22.4 | F | 4.8 |

The proportion of zirconium phosphate glass in the mixture with commercial titanium white enamel is about 35 to 55% by weight, preferably more than 45% by weight.

Titanium white enamels are well known, conventional types of enamel (see, e.g., A. I. Andrews, *Porcelain Enamels*, page 277).

The panel heating elements according to the invention may be used for the following purposes: Heating elements for space heating, integrated heating elements for heating water, for cooking utensils and water heaters, and heating elements for toasters and for warming plates.

The subject of the present invention will now be explained in more detail with the aid of the following Example.

INSULATING GLASS LAYER

A mixture of 250.2 g of boric acid, 176.7 g of calcium carbonate, 12.0 g of magnesium carbonate, 5.1 g of quartz and 57.9 g of clay having the composition $SiO_2$ (48%) and $Al_2O_3$ (38%) placed inside a quartz lined fireclay crucible which had already been compacted by repeated fusion was melted in an electrically heated oven at 1200° C. for 20 to 30 minutes. The clear molten flux was quenched between steel rollers. The flakes were then ground to a slip in a porcelain ball mill with the addition of the following substances:

| | % by weight |
|---|---|
| Frit | 100 |
| Calcium silicate hydrate | 0.1 |
| Aluminium phosphate | 0.2 |
| Calcium phosphate | 0.2 |
| Bentonite | 0.7 |
| Water | about 50 |
| Fineness of milling | 0.5% residue on a 3600 mesh screen |
| Density | 1.68 g/ml |

QUALITY OF STEEL AND PRETREATMENT

Decarbonized steel according to DIN 1623, part 3, quality ED 3 is degreased in the usual manner and pickled with 8% sulphuric acid at 70° C. until the weight loss on both sides is 40 g/m$^2$. The steel is then rinsed with water and nickel-plated by immersion in nickel sulphate solution (1 g nickel/m$^2$).

APPLICATION AND FIRING

The insulating glass slip is applied by spray gun to both sides of steel sheets 1 mm in thickness measuring 100×100 mm, the amount applied being calculated so that the fired layer on one side will have a thickness of 180 μm and on the other side a thickness of about 70 μm. The application on both sides prevents distortion. The metallic heating conductor is applied to the thick coated side, avoiding air bubbles, while the latter is still moist and the whole assembly is dried and stoved at 820° C. for 6 minutes.

COVERING LAYER

A mixture of 15.6 g of quartz powder, 19.5 g of sodium tripolyphosphate, 1.8 g of potassium carbonate, 7.5 g of titanium dioxide, 20.5 g of zirconium silicate, 18.7 g of monobarium phosphate, 10.9 g of monopotassium phosphate and 9.7 g of potassium silicofluoride was melted at 1400° C. in a fireclay crucible for 25 minutes, the temperature was lowered to 1250° C. for 10 minutes and the mixture was then quenched in water, The resulting granules together with a commercial titanium white enamel were ground to a slip with the following mill formula in a ball mill:

| | % by weight |
|---|---|
| Frit | 50.0 |
| Titanium white enamel | 50.0 |
| Blue clay | 4.0 |
| Sodium aluminate | 0.2 |
| Potash | 0.2 |
| Water | about 45 |
| Milling fineness | 5% residue on 16,900 mesh screen |
| Density | 1.74 g/ml |

It will be appreciated that the instant specification and claims are set forth by way of illustration and not limitation and that various modifications and changes may be made without departing from the spirit and scope of the present invention.

What is claimed is:

1. A panel heating element comprising (a) a metal substrate, (b) an aluminum boron-silicate insulating glass which forms a coating on the metal substrate, (c) one or more metallic resistance tracks applied to the substrate and (d) a mixture of a zirconium phosphate glass and a boron-titanium enamel which is applied as a layer over the metallic resistance tracks.

2. A panel heating element according to claim 1, wherein the insulating glass has the following composition:

43 to 48% by weight $B_2O_3$
29 to 34% by weight CaO
8 to 15% by weight $SiO_2$
7 to 10% by weight $Al_2O_3$
1 to 2% by weight MgO.

3. A panel heating element according to claim 1, wherein the zirconium phosphate glass has the following composition:

$ZrO_2$: 26 to 30% by weight
$P_2O_5$: 21 to 25% by weight
$SiO_2$: 7 to 12% by weight
$Na_2O$: 6 to 10% by weight
$K_2O$: 8 to 12% by weight
$TiO_2$: 6 to 10% by weight
BaO: 8 to 12% by weight
F: 3 to 8% by weight.

4. A panel heating element according to claim 1, wherein the proportion of enamel amounts to more than 45% by weight in the mixture with the zirconium phosphate glass.

5. A panel heating element according to claim 1, wherein the zirconium phosphate glass has the following composition:

$SiO_2$: 9.5% by weight
$TiO_2$: 7.3% by weight
$ZrO_2$: 27.5% by weight
$P_2O_5$: 22.4% by weight
$Na_2O$: 8.4% by weight
$K_2O$: 9.4% by weight
BaO: 10.7% by weight
F: 4.8% by weight.

6. A panel heating element according to claim 1, wherein the zirconium phosphate glass amounts to 35 to 55% by weight in the mixture with the boron-titanium enamel.

7. A panel heating element according to claim 1, wherein the metal substrate is a steel.

* * * * *